US010082277B2

(12) United States Patent
Dubosc et al.

(10) Patent No.: US 10,082,277 B2
(45) Date of Patent: Sep. 25, 2018

(54) LIGHT MODULE COMPRISING AN ORGANIC LIGHT EMITTING DIODE

(71) Applicant: Valeo Vision, Bobigny (FR)

(72) Inventors: Christophe Dubosc, Villemomble (FR); Damien Cabanne, Martos (ES); Benoit Reiss, Margency (FR); Eric Moisy, Jaen (ES)

(73) Assignee: VALEO VISION, Bobigny (FR)

( * ) Notice: Subject to any disclaimer, the term of this patent is extended or adjusted under 35 U.S.C. 154(b) by 149 days.

(21) Appl. No.: 14/916,318

(22) PCT Filed: Sep. 8, 2014

(86) PCT No.: PCT/EP2014/069101

§ 371 (c)(1),
(2) Date: Mar. 3, 2016

(87) PCT Pub. No.: WO2015/032949

PCT Pub. Date: Mar. 12, 2015

(65) Prior Publication Data

US 2016/0215963 A1 Jul. 28, 2016

(30) Foreign Application Priority Data

Sep. 9, 2013 (FR) ..... 13 58643

(51) Int. Cl.

| | |
|---|---|
| ***F21S 8/10*** | (2006.01) |
| ***F21V 21/00*** | (2006.01) |
| ***F21V 19/00*** | (2006.01) |
| ***F21S 41/19*** | (2018.01) |
| ***F21S 41/155*** | (2018.01) |

(Continued)

(52) U.S. Cl.
CPC ..... *F21V 19/0015* (2013.01); *F21S 41/155* (2018.01); *F21S 41/192* (2018.01);
(Continued)

(58) Field of Classification Search
CPC .. F21S 48/1109; F21S 48/1163; F21S 48/212; F21S 48/217; F21V 19/0015; F21Y 2105/00; F21Y 2115/15
(Continued)

(56) References Cited

U.S. PATENT DOCUMENTS 6,670,207 B1 * 12/2003 Roberts ..... B60Q 1/2665 257/E23.044
8,328,375 B2 * 12/2012 Diekmann ..... F21S 6/002 313/504

(Continued)

FOREIGN PATENT DOCUMENTS

EP 2221531 A2 8/2010
EP 2592331 A1 5/2013

*Primary Examiner* — Tsion Tumebo
(74) *Attorney, Agent, or Firm* — Oblon, McClelland, Maier & Neustadt, L.L.P.

(57) ABSTRACT

A light module, comprising: a support comprising at least one first surface called a separating surface and at least one organic light-emitting diode comprising a first light-emitting part, a connecting part or means for attaching the diode to the support and an electrical connector or means for electrically connecting the diode. The means for attaching the diode and the electrical connector or means for electrically connecting the diode are borne by a part of this diode, called a connecting part. Additionally, the separating surface of the support delimits a light-scattering area into which the first light-emitting part of the diode extends, and separates this light-scattering area from a masked area, into which connecting part of the diode extends, such that the connecting part is occulted by the separating surface of the support.

2 Claims, 5 Drawing Sheets

(51) Int. Cl.
*F21S 43/19* (2018.01)
*F21S 43/145* (2018.01)
*F21Y 105/00* (2016.01)
*F21Y 115/15* (2016.01)

(52) U.S. Cl.
CPC ..... *F21S 43/145* (2018.01); *F21S 43/195* (2018.01); *F21Y 2105/00* (2013.01); *F21Y 2115/15* (2016.08)

(58) Field of Classification Search
USPC ..... 362/544, 559
See application file for complete search history.

(56) References Cited

U.S. PATENT DOCUMENTS 8,833,990 B2 * 9/2014 Tessnow ..... F21S 48/1104 174/153 G
2001/0053082 A1 * 12/2001 Chipalkatti ..... B60Q 1/26 362/496
2002/0149312 A1 * 10/2002 Roberts ..... H01L 23/42 313/495
2005/0248935 A1 * 11/2005 Strip ..... G06F 1/1601 362/145
2006/0193137 A1 * 8/2006 Chinniah ..... F21V 5/04 362/326
2007/0147063 A1 * 6/2007 Collomb ..... H01H 19/025 362/551
2011/0261568 A1 * 10/2011 Dalsgaard ..... F21V 21/30 362/249.03
2013/0044487 A1 * 2/2013 Burrows ..... F21V 14/02 362/249.08
2015/0282269 A1 * 10/2015 Krall ..... H05B 33/0845 362/230
2016/0059767 A1 * 3/2016 Kwak ..... B60Q 1/2638 362/520

* cited by examiner

LIGHT MODULE COMPRISING AN ORGANIC LIGHT EMITTING DIODE

CROSS-REFERENCE TO RELATED APPLICATIONS

This application is the U.S. National Phase application of PCT Application No. PCT/EP2014/069101 filed Sep. 8, 2014, which claims priority to the French application 1358643 filed on Sep. 9, 2013, which applications are incorporated herein by reference and made a part hereof.

BACKGROUND OF THE INVENTION

1. Field of the Invention

The invention relates to the technical field of lighting and signaling for automotive vehicles, and in particular concerns light modules intended to be integrated in lighting and/or signaling housings comprising organic light-emitting diodes, also known by the acronym OLED.

2. Description of the Related Art

Recent technological advancements, tending to prolong the lifespan of organic light-emitting diodes and reduce the manufacturing costs thereof, have sparked the interest of vehicle stylists and designers in these light sources. They make it possible to produce light effects that are difficult to achieve with light sources such as filament bulbs or even LED bulbs. As such, demonstrators clustering together multiple light-emitting diodes of the same color or different colors have recently been featured on experimental vehicles.

These organic light-emitting diodes also present the advantage of consuming little energy.

An organic light-emitting diode generally takes the form of a thin blade comprising a substrate generally made of glass, on which are superposed an anode and a cathode between which one or more layers of organic material are arranged containing, for example, materials such as polyanilines or polyfluorenes. This embodiment is not limiting, as presently issuing from laboratories are organic light-emitting diodes implemented on flexible substrates.

Due to the fragility of the glass substrate, the existing systems employing these types of diodes integrate frames completely surrounding the periphery of the diode, so as to protect the diode during successive manipulations occurring throughout the assembly process. These frames have the drawback, however, of limiting the style effects.

Indeed, in order to improve the sought-after light effects, stylists seek to have only the light-emitting surface itself visible, and to keep the technical elements required for the operation of the organic light-emitting diode out of sight of an observer looking at the vehicle.

Furthermore, due to their intended role, a great deal of attention is paid to the maintainability and the interoperability of these devices, as well as to the processes for mounting and assembly in the vehicle, during which it is paramount to preserve the integrity of the components while keeping the assembly costs under control.

Lastly, if the majority of the surface of the wall of the diode is reserved for the light-emitting area, it is nevertheless still necessary to provide means for electrically linking with the control members of the vehicle, as well as mechanical means for linking with the signaling member.

These technical, economic and aesthetic imperatives together therefore limit the use of shields intended to mask the technical elements, or retaining frames enclosing the light-emitting diode around its periphery.

An aim of the invention is to provide a technical solution to this problem.

SUMMARY OF THE INVENTION

The light module according to the invention, intended to be integrated in a lighting and/or signaling housing, comprises

- a support comprising at least one first surface called separating surface; and
- at least one organic light-emitting diode comprising a first light-emitting part, means for attaching the diode to the support and means for electrically connecting the diode.

The light module possesses the following characteristics:

- a means for attaching the diode and a means for electrically connecting the diode are borne by a part of this diode, called a connecting part; and
- a separating surface of the support delimits a light-scattering area into which the first light-emitting part of the diode extends, and separates the light-scattering area from a masked area, into which the connecting part of the diode extends, such that the connecting part is occulted by the separating surface of the support.

The separating surface must here be understood to be, as a general rule, the part of the surface of the support that is visible from the exterior of the vehicle in which the light module is intended to be mounted. As such, this separating surface may form an integral part of the general style of the vehicle. Provision may however also be made to cover it or conceal it with a mask, in order to hide the imperfections and defects of this separating surface.

In this way, the light module according to the invention makes it possible to exclude the technical elements of the organic light-emitting diode from the view of outside observers by positioning them below the separating surface. This arrangement furthermore makes it possible to achieve a sought-after visual effect, in that the light-emitting part of the diode appears to float above the separating surface without betraying the presence of the technical elements that are supported by the connecting part.

Preferably, the organic light-emitting diode comprises a thin blade the outer profile of which is delimited by edges of low thickness. Thin or low thickness is here understood to mean nominal values that are smaller by a factor of 10, or even 100, than the nominal value of the width or length of the blade forming the diode.

Preferably, the connecting part of the organic light-emitting diode comprises two lateral excrescences.

The invention also comprises the case in which the light-emitting diode comprises a second light-emitting part separate from the first light-emitting part, the first and second light-emitting parts being separated from one another by the connecting part, and the support comprising two opposite separating surfaces, such that the connecting part is placed between each of the separating surfaces.

Preferably, the support comprises a wall supporting the separating surface, the wall comprising at least one slot passing all the way therethrough, such that the connecting part of the light-emitting diode passes through the wall and comes out on a technical surface of the support, the technical surface being opposite the separating surface.

Preferably, a centering border, comprising an inner surface placed on the periphery of the slot, is positioned on the technical surface of the support.

Preferably, the angle formed by the inner surface of the centering border with the technical surface determines the gradient of the light-emitting part with respect to the separating surface of the support.

Preferably, the edges of the lateral excrescences facing the light-emitting part form lower support edges which are in contact with parts of the technical surface or of the slot, or parts of the centering border or of its inner surface, and which are arranged in such a way as to prevent the connecting part from extending from the side of the separating surface that forms the light-scattering area.

Preferably, the lower support edges have a conical form making it possible to compensate for assembly clearances.

Preferably, the parts of the slot or the parts of the inner surface of the centering border, which are intended to come into contact with the lower support edges of conical form, also have a conical form.

Preferably, the support comprises, on its technical surface side, fastening means capable of being directly connected to the support and to the connecting part of the organic light-emitting diode.

Preferably, the fastening means comprise a releasable locking element, resting on an upper support edge of the connecting part of the organic light-emitting diode.

Preferably, the locking element comprises support ribs intended to rest on the upper support edge of the connecting part of the organic light-emitting diode.

Preferably, the locking element comprises an articulation connected to the technical surface of the wall of the support or connected to the centering border.

Preferably, the locking element comprises a first fastening element intended to be connected by clipping together with a second fastening element positioned on the technical surface of the support or positioned on the centering border.

Preferably, the locking element comprises an eyelet which, when the locking element is resting on the upper support edge of the connecting part, is coaxial with a hole made in the wall of the support, or made in the centering border, the eyelet and the hole being capable of receiving a locking screw.

Preferably, the means for electrically connecting the organic light-emitting diode are positioned on the lower support edges.

Additionally, when the fastening means comprise a releasable locking element resting on an upper support edge of the connecting part, the means for electrically connecting the organic light-emitting diode may also be positioned on the upper support edge.

Preferably, the connecting part of the organic light-emitting diode is mechanically connected to the support by means of an intermediate fastening module.

Preferably, the intermediate fastening module comprises means for connecting to the technical surface of the wall of the support.

Preferably, the intermediate fastening module comprises eyelets arranged such that, when the intermediate fastening module is mounted on the support, the eyelets are coaxial with holes made in mounting shanks positioned on the technical surface of the support, the eyelet and the hole being capable of receiving a locking screw.

Preferably, the intermediate fastening module comprises means for electrically linking with the electrical connection means of the organic light-emitting diode.

Preferably, the intermediate fastening module comprises two retaining clips, the clips being connected together by clamping means, such that the organic light-emitting diode is held in place by the pressure exerted by the two retaining clips on opposite support surfaces of the connecting part.

Preferably, at least one of the clips comprises at least one support tab, being formed as an integral part of the retaining clip and joined by one of its sides thereto, in such a way as to form a flexible connection between the retaining clip and one of the support surfaces of the connecting part.

Preferably, at least one of the retaining clips comprises positioning excrescences intended to come into contact with the edges of the connecting part, in such a way as to limit the movements of the organic light-emitting diode in the intermediate fastening module.

Preferably, the clamping means of the mutual retaining clips are formed by means chosen from among:

- means for clipping together working in conjunction;
- male elements borne by one of the retaining clips press-fitted into female elements borne by the other retaining clip;
- screwing means and
- bonding or welding means.

The invention also relates to a lighting and/or signaling housing intended to be mounted on an automotive vehicle comprising at least one light module according to the invention.

These and other objects and advantages of the invention will be apparent from the following description, the accompanying drawings and the appended claims.

BRIEF DESCRIPTION OF THE ACCOMPANYING DRAWINGS

The invention will be better understood upon reading the appended figures, which are provided by way of examples and are in no way limiting, in which.

Figure 3A:
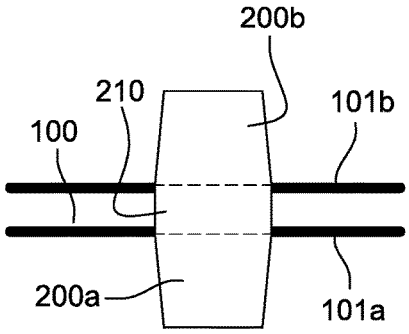
Figure 3B:
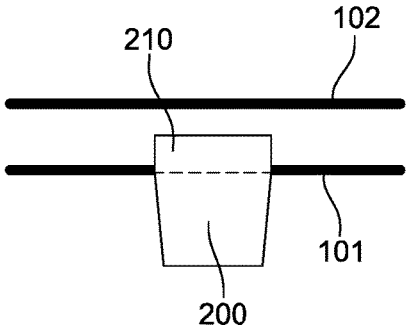
Figure 4:
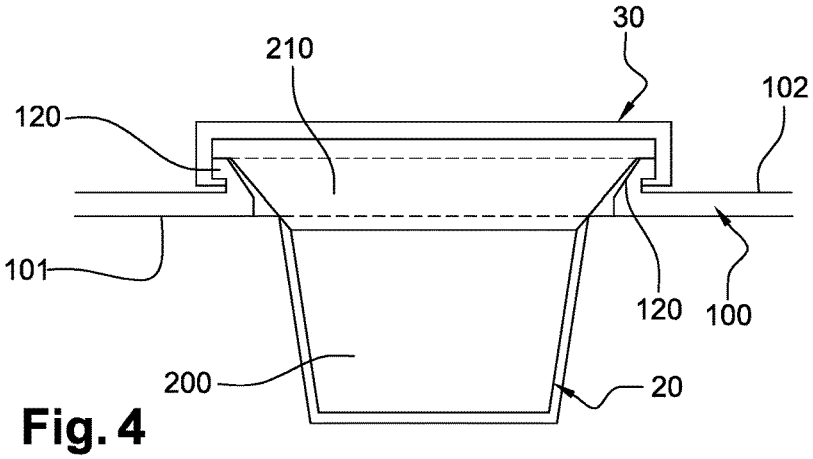
Figure 5:
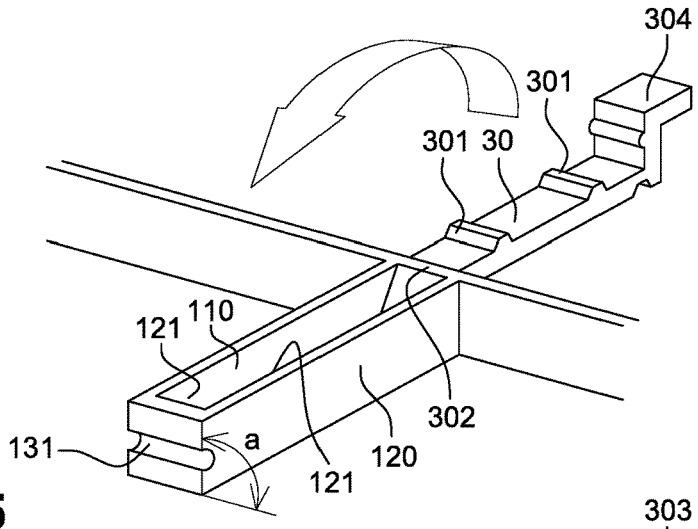
Figure 6:
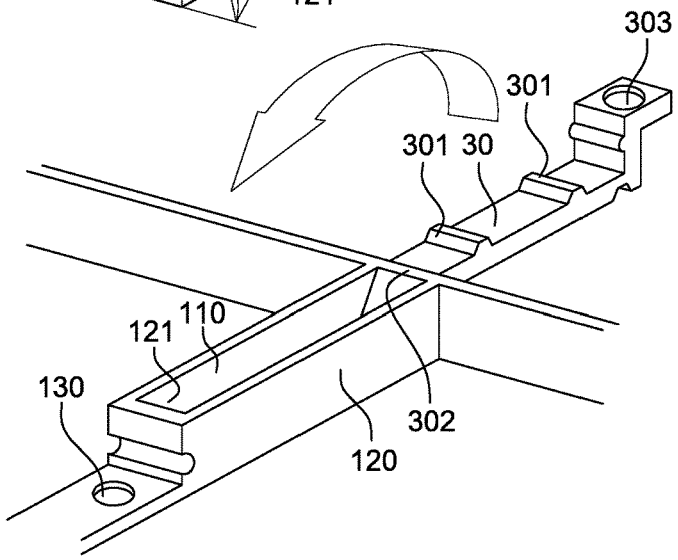
Figure 9:
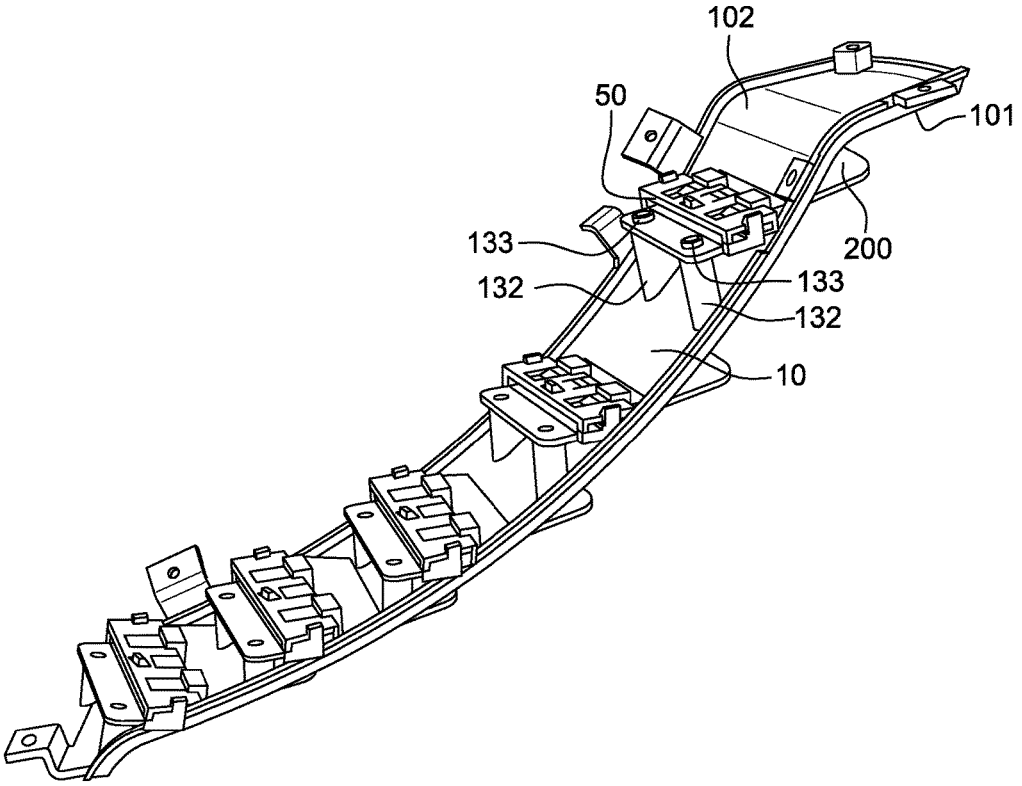
Figure 10:
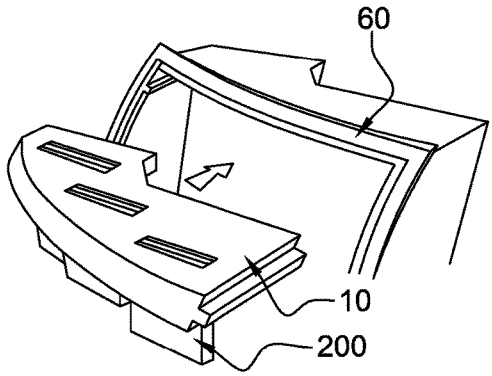
Figure 11:
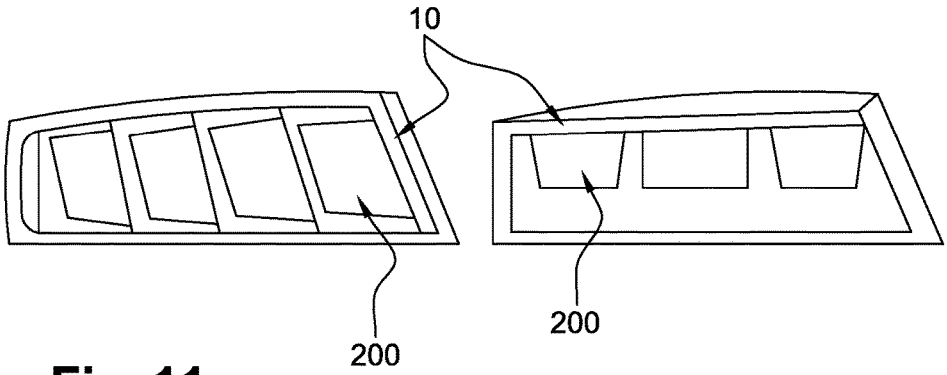
Figure 12:
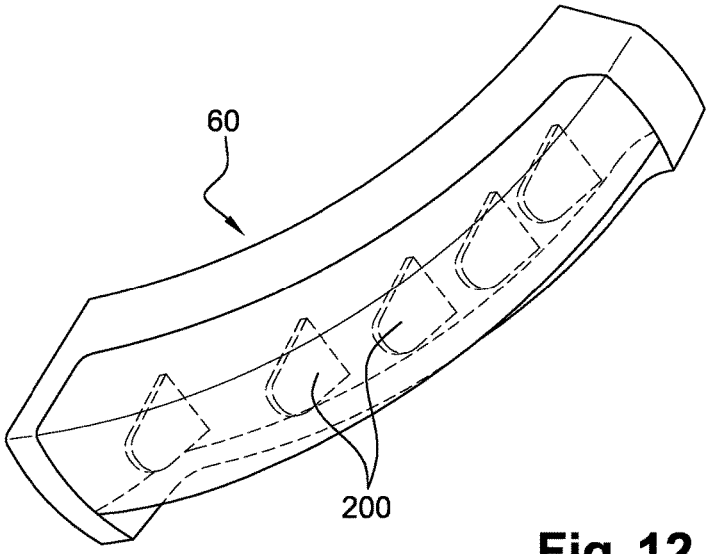

FIGS. 3*a* and 3*b* show other possible embodiments of the invention;

FIG. 4 shows a perspective view of a variant of the first alternative embodiment of the invention;

FIGS. 5 and 6 show perspective views of the way in which a locking element is fastened according to this first alternative;

FIGS. 7*a*, 7*b*, 7*c* and 7*d*, as well as FIGS. 8*a*, 8*b*, 8*c* and 8*d*, show perspective views of a second alternative embodiment of the invention comprising an intermediate fastening module;

FIG. 9 shows a perspective view of a way in which the support and the intermediate fastening modules are connected together; and FIGS. 10, 11 and 12 show perspective views of a light module according to the invention, inserted into a signaling housing having various style effects.

DETAILED DESCRIPTION OF THE PREFERRED EMBODIMENTS

Figure 1:
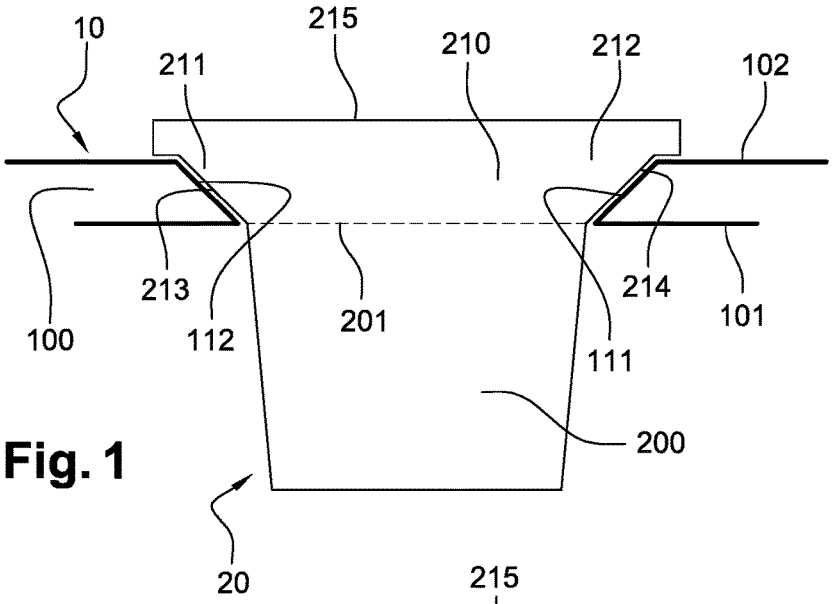
FIG. 1 shows a cross-sectional view of a first alternative embodiment of the invention.

FIG. 1 shows a portion of a support 10 formed of a wall 100 comprising a separating surface 101.

Figure 2:
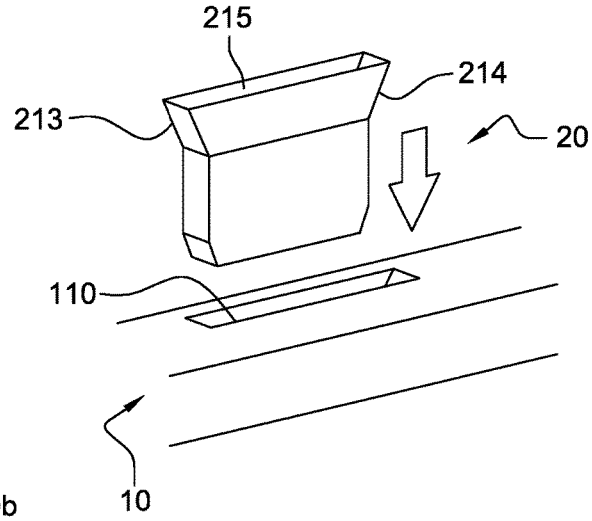
FIG. 2 shows, in a perspective view, an organic light-emitting diode inserted into an element of the support.

An organic light-emitting diode 20 is inserted into a slot 110 that passes through the wall 100 of the support 10, as illustrated in FIG. 2.

This light-emitting diode 20 comprises a light-emitting part 200 and a connecting part or means for connecting 210, separated by an imaginary dotted line 201 located exactly in line with the separating surface 101 as shown in FIG. 1.

The connecting part 210 is therefore placed on the other side of the separating surface 101 and remains masked by the separating surface 101 for an observer positioned outside the vehicle.

In this embodiment of the invention, the connecting part 210 passes completely through the wall 100 of the support 10 and emerges on the side of the surface 102 of the wall 100, opposite the separating surface 101, and named technical surface because it is not visible from the exterior of the vehicle.

The general form of the organic light-emitting diode 20 is that of a flat and thin blade, bordered by edges of low thickness 213, 214, 215.

The wall of the connecting part 210 of the organic light-emitting diode 20 comprises two lateral excrescences 211 and 212. The lower support edges 213 and 214 of the lateral excrescences 211 and 212 facing the light-emitting part 200 come into contact with the technical surface 102 in such a way as to limit the travel of the organic light-emitting diode 20 in the slot 110, such that the imaginary line 201 separating the light-emitting part 200 from the connecting part 210 may be located exactly at the level of the separating surface 101.

In order to compensate for the positioning clearances, the lower support edges 213 and 214 may advantageously be converging inclined faces. The connecting part 210 of the organic light-emitting diode 20 then has an overall trapezoidal form the small base of which is extended by the light-emitting part 200. In the case illustrated by FIG. 1, the lower support edges 213 and 214 come directly into contact with the lateral ends 111 and 112 of the slot 110, which are also correspondingly in the form of an inclined face in such a way as to promote proper positioning of the organic light-emitting diode 20 in the slot 110.

The embodiment of the invention such as shown in FIGS. 1 and 2, in which the organic light-emitting diode 20 passes all the way through the wall 100 of the support 10, and in which the connecting part 210 emerges from the side of the technical surface 102, must not be considered as a sole embodiment of the invention.

FIGS. 3*a* and 3*b* allow for embodiments also included within the field of the invention to be illustrated.

FIG. 3*a* illustrates the case in which the support 10 comprises two separating surfaces 101*a* and 101*b*, located so as to be facing one another, and in which the organic light-emitting diode 20 comprises two light-emitting parts 200*a* and 200*b* located on either side of the connecting part 210 that is positioned between the two separating surfaces 101*a* and 101*b*.

FIG. 3*b* illustrates the case in which the connecting part 210 is placed between the separating surface 101 and the technical surface 102, and does not pass through the wall 100 of the support 10.

Furthermore, the present invention also encompasses variant embodiments in which the light-emitting parts 200, 200*a* and 200*b* of the diodes are subdivided into multiple subsectors, the lighting up of which is controlled independently of one another.

FIGS. 4, 5 and 6 allow for a variant of the first alternative embodiment of the invention to be illustrated, in which a centering border 120, here taking the form of a wall, is positioned on the technical surface 102 of the support 10. The inner surface 121 of the centering border 120 surrounds the periphery of the slot 110.

This centering border 120 makes it possible to secure the retention of the organic light-emitting diode 20 in the slot 110.

It is also possible to incline the inner surface 121 of the centering border 120 at an angle (a) with respect to the technical surface 102, when the desire is to have the organic light-emitting diodes 20 stand out with a relative gradient with respect to a normal direction on the separating surface 101, as illustrated in FIG. 5.

The parts of the inner surface 121 that are in contact with the inclined lower support edges 213, 214 of the connecting part 210 may also have a beveled form extending the form of the lateral ends 111 and 112 of the slot 110.

A releasable locking element 30 is positioned on the centering border 120.

In the closed position, the locking element 30 rests on the upper support edge 215 of the organic light-emitting diode 20 in such a way as to hold the organic light-emitting diode 20 in the slot 110. In the open position, it permits the organic light-emitting diode 20 to be removed.

The face of the locking element 30 that is in contact with the upper support edge 215 of the organic light-emitting diode 20 may comprise ribs 301 in order to promote contact between these two members.

The locking element 30 is mounted on the centering border 120 by means of an articulation 302, and comprises a releasable locking means that engages with a corresponding device positioned on the technical surface 102 or on the centering border 120 itself.

It will be observed here that the articulation of this locking element 30 may equally be mounted directly on the wall 100 of the support 10 on the technical surface 102 side.

By way of example, the releasable locking means may be composed of a first clip-fastening element 304 that engages with a second clip-fastening element 131 positioned on the technical surface 102, or on the centering border 120 as illustrated in FIG. 5, or even of an eyelet 303 positioned on the opposite side of the articulation 302, that is coaxial, in the closed position, with a hole 130 made in the centering border 120, or in the wall 100 of the support 10 as illustrated in FIG. 6, and making it possible to receive a locking screw.

It will be noted that if the locking element 30 does not comprise any articulation 302, these releasable locking means may be combined in pairs, separately or together.

The contact between the electrical connection means that are positioned on the connecting part of the organic light-emitting diode 20 and the power supply and control means originating in the vehicle may advantageously be made at the lower support edges 213 and 214, or even at the upper support edge 215. The corresponding electrical connection means are then positioned respectively on the technical surface 102 or on the lateral ends 111 and 112 of the slot 110, in contact with the lower support edges 213 or 214, or even on the surface of the locking element 30 that is in contact with the upper support edge 215. According to an advantageous variant, the electrical connection means may be directly integrated in the constitutive material of the support 10, at the very least on the technical surface 102, by making recourse to MID (molded interconnect device) techniques, in particular with the creation of conductive traces on the technical surface 102.

FIGS. 7 and 8 show a second alternative embodiment of the invention, in which the organic light-emitting diode 20 is connected to the support 10 by means of an intermediate fastening module 50.

This alternative solution is mainly of interest due to the ease of connecting and of mounting the organic light-emitting diode 20 on the support 10 at the moment of assembly and also during maintenance operations, in order to ensure the replacement of defective organic light-emitting diodes 20.

Figure 7A:
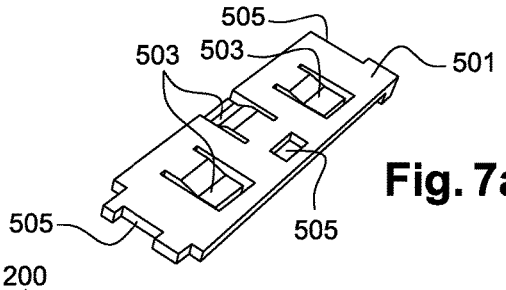
Figure 8A:
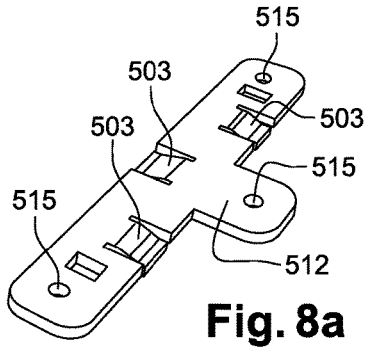
Figure 7B:
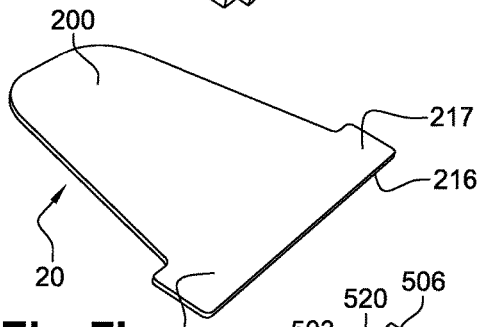
Figure 8B:
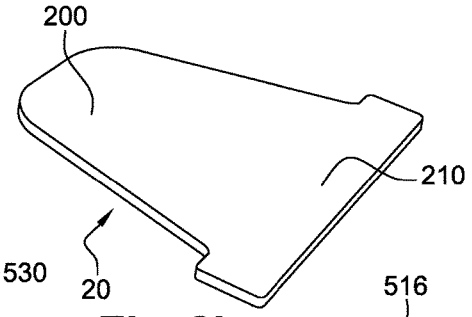
Figure 7C:
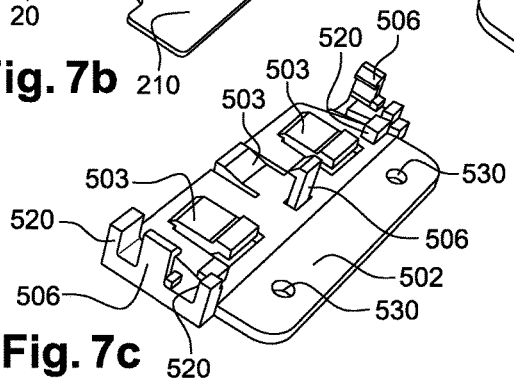
Figure 8C:
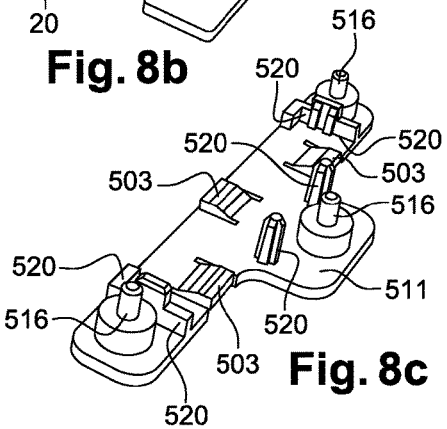
Figure 7D:
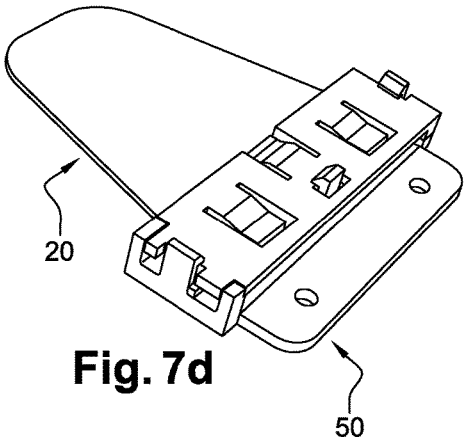
Figure 8D:
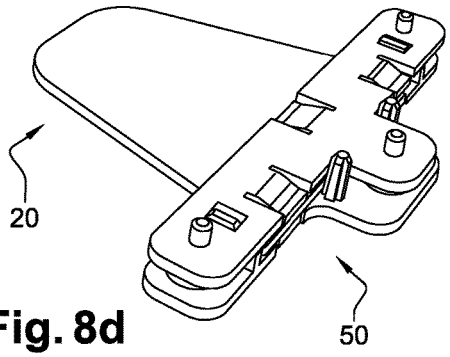

In the examples supporting the present description, the intermediate fastening module 50 is composed of two retaining clips 501 and 502 that enclose the opposite support surfaces 216, 217 of the connecting part 210 of the organic light-emitting diode 20, as shown in FIGS. 7*d* and 8*d*.

The two retaining clips 501 and 502 are connected to one another by releasable clamping means that permit the mounting and dismounting of the organic light-emitting diode 20.

By way of example, FIGS. 7*a*, 7*b*, 7*c* and 8*a*, 8*b* and 8*c* allow for the mounting details of the two retaining clips 501 and 502 to be illustrated according to two possible and non-limiting variant embodiments.

In the first variant embodiment illustrated by FIGS. 7*a*, 7*b* and 7*c*, the two retaining clips 501 and 502 are connected to one another by clipping elements 505, 506 positioned respectively on the opposite faces of each of the retaining clips 501 and 502 and clicking into one another.

In the second variant embodiment illustrated by FIGS. 8*a*, 8*b* and 8*c*, the two retaining clips 511 and 512 are connected together by male elements 516 positioned on a first retaining clip 511 and press-fitted into holes 515 made in the second retaining clip 512. In order to ensure that the fitting is properly held in place, the male elements 516 may have a slightly conical form. The locking together of the two retaining clips 511 and 512 may then be carried out by staking the free ends of the male elements 516.

The connection between the two retaining clips 501 and 502, 511 and 512 may also be made by screwing, or even by bonding or by welding, in the latter two cases taking into consideration that the intermediate connection module is no longer detachable from the organic light-emitting diode 20.

In order to improve the contact between the two retaining clips 501 and 502, 511 and 512 and the connecting part 210 of the organic light-emitting diode 20, it may prove useful to position, on the inner faces of the two retaining clips 501 and 502, 511 and 512, support tabs 503 that ensure a flexible connection with the support surfaces 216, 217 of the connecting part 210 of the organic light-emitting diode 20.

To this end, each of the support tabs 503 is formed as an integral part of the retaining clip 501, 502, 511, 512 and joined by one of its sides thereto, and comes into contact with the support surface 216, 217 of the connecting part 210 of the organic light-emitting diode 20 by the side opposite this connection. The body of the support tab 503 is shifted toward the inner side of the retaining clip 501, 502, 511, 512. By experimenting with the elasticity of the material or with the thickness of the support tab 503 at the connection between the support tab 503 and the retaining clip 501, 502, 511, 512, the strength of the clamping between the support surface 216, 217 of the connecting part 210 of the organic light-emitting diode 20 and the retaining clips 501, 502, 511, 512 may advantageously be adjusted.

The electrical contact between the connecting part 210 of the organic light-emitting diode 20 and the power supply and control elements of the vehicle may advantageously by made at the support tabs 503 bearing on the surface of the connecting part 210.

At least one of the retaining clips 501, 502, 511, 512 comprises positioning excrescences 520 intended to come into contact with the lower support edges 213 and 214 and the upper support edge 215 of the connecting part 210 of the organic light-emitting diode 20, in such a way as to limit the movements of the organic light-emitting diode 20.

One of the retaining clips 501, 502, 511, 512 comprises means for connecting to the support 10. By way of example, the retaining clip 502 illustrated in FIGS. 7*c* and 7*d* comprises eyelets 530.

According to a variant embodiment not shown, the two retaining clips 501 and 502, 511 and 512 may be connected together by a flexible hinge. They may thus form one component piece made of the same material, achieved by injection molding.

FIG. 9 allows for the mounting, on a support 10, of multiple intermediate fastening modules, each comprising an organic light-emitting diode 20, to be visualized.

The wall 100 of the support 10 comprises slots into which the organic light-emitting diodes 20 are slipped such that only the light-emitting part 200 emerges from the separating surface 101.

The wall 100 of the support 10 also comprises protuberances 132, taking the form of cylindrical shanks, positioned on the technical surface 102 side. These protuberances 132 comprise holes, adjusted so as to be coaxial with the eyelets 530 that are placed on the intermediate modules supporting the organic light-emitting diode 20, and capable of receiving a fastening screw 133 at the moment of assembly.

Of course, this means for connecting the intermediate fastening module and the support 10 by screwing is not limiting. It is thus entirely possible to envisage a means for connecting by clipping together, by snap-fitting, or even by bonding or by welding if the notion of the intermediate fastening module being removable from the support 10 is dropped.

The light module shown in FIG. 9 comprises a plurality of light-emitting diodes 20, each making a chosen angle with the separating surface 101 in such a way as to create the sought-after style effect.

FIG. 10 illustrates a way in which a light module according to the invention is integrated in a lighting and/or signaling housing 60. In particular, the housing 60 is equipped with grooves with which tabs or the lateral edges of the support 10 of the light module engage; the light module is thus inserted into the housing 60 by being slid into these grooves.

FIGS. 11 and 12 allow for the style effects made possible by the invention to be visualized. The light-emitting parts 200 emerge from the separating surface 101 at various angles and orientations, without betraying the presence of the technical elements that are located on the other side of the separating surface 101.

The embodiments of the invention on which the present description is based are not limiting, as long as they allow for the technical effects as claimed to be achieved.

Thus, for example, provision may be made for the separating surface 101 to be reflective. Likewise, in order to improve the aesthetic rendition, provision may be made for the light module to comprise an additional mask, equipped with apertures through which the diodes pass, intended to cover the separating surface 101 and to shield the imperfections of this surface from view.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A light module, comprising:

a support comprising a separating surface; and at least one organic light-emitting diode including a first light-emitting part, a connecting part attaching said organic light-emitting diode to said support, and an electrical connector electrically connecting said organic light-emitting diode, wherein said connecting part attaching said organic light-emitting diode and said electrical connector electrically connecting said organic light-emitting diode are both borne by the connecting part of said organic light-emitting diode, wherein said separating surface of said support delimits a light-scattering area into which said first light-emitting part of said organic light-emitting diode extends, and separates said light-scattering area from a masked area, into which said connecting part of said organic light-emitting diode extends, such that said connecting part is occulted by said separating surface of said support, and wherein said support comprises a wall supporting said separating surface, said wall comprising at least one slot passing all the way therethrough, such that said connecting part of said organic light-emitting diode passes through said wall and comes out on a technical surface of said support, said technical surface being opposite said separating surface.

2. The light module as claimed in claim 1, in which said organic light-emitting diode comprises a second light-emitting part separate from said first light-emitting part, said first light-emitting part and said second light-emitting part being separated from one another by said connecting part, and said support comprising two opposite separating surfaces, such that said connecting part is placed between each of said separating surfaces.

* * * * *